US005748760A

United States Patent [19]

Button

[11] Patent Number: 5,748,760

[45] Date of Patent: May 5, 1998

[54] DUAL COIL DRIVE WITH MULTIPURPOSE HOUSING

[75] Inventor: Douglas J. Button, Champaign, Ill.

[73] Assignee: Harman International Industries, Inc., Northridge, Calif.

[21] Appl. No.: 798,124

[22] Filed: Feb. 12, 1997

Related U.S. Application Data

[63] Continuation of Ser. No. 423,308, Apr. 18, 1995, abandoned.

[51] Int. Cl.[6] ..... H04R 25/00

[52] U.S. Cl. ..... 381/199; 381/194; 381/204

[58] Field of Search ..... 381/197, 194, 381/192, 199, 205

[56] References Cited

U.S. PATENT DOCUMENTS

| | | | |
|---|---|---|---|
| 3,201,529 | 8/1965 | Surh | 381/199 |
| 3,881,074 | 4/1975 | Kawamura | 381/194 |
| 3,991,286 | 11/1976 | Henrickson . | |
| 4,401,501 | 8/1983 | Hasselbach et al. . | |
| 4,465,905 | 8/1984 | Nation . | |
| 4,808,955 | 2/1989 | Godkin et al. | 335/222 |
| 5,040,221 | 8/1991 | Edwards et al. | 381/192 |
| 5,151,943 | 9/1992 | Van Gelder | 381/199 |
| 5,231,336 | 7/1993 | Van Namen . | |
| 5,390,257 | 2/1995 | Oslac et al. . | |
| 5,402,503 | 3/1995 | Prosich et al. . | |
| 5,446,797 | 8/1995 | Paddock | 381/199 |
| 5,449,261 | 9/1995 | Button . | |

FOREIGN PATENT DOCUMENTS

| | | | |
|---|---|---|---|
| 04922142 | 11/1991 | European Pat. Off. . | |
| 1180456 | 12/1958 | France . | |
| 6-233380 | 8/1994 | Japan | 381/199 |
| WO94030236 | 2/1994 | WIPO | H04R 25/00 |

*Primary Examiner*—Sinh Tran
*Attorney, Agent, or Firm*—Jones, Day, Reavis & Pogue

[57] ABSTRACT

An improved electromagnetic transducer able to produce more power per mass than a conventional transducer. This increased power per mass is made possible by combining a properly designed housing, a neodymium magnet and a dual coil structure. This design dissipates the heat generated by the transducer, increasing the efficiency and power of the transducer. Also, by dissipating heat more efficiently, the transducer can be made smaller and more powerful than conventional transducers.

24 Claims, 4 Drawing Sheets

DUAL COIL DRIVE WITH MULTIPURPOSE HOUSING

This application is a continuation of application Ser. No. 08/423,308, filed Apr. 18, 1995, now abandoned.

BACKGROUND

1. Field of Invention

This invention relates generally to audio transducers. More particularly, this invention relates to the design of a light weight, high power audio transducer.

2. Related Art

Most electrodynamic loudspeakers use magnets to produce magnetic flux in an air gap. These magnets are typically permanent magnets, used in a magnetic circuit of ferromagnetic material to direct most of the flux produced by the permanent magnet into an air gap.

A voice coil is placed in this air gap with its conductors wound substantially cylindrically so as to be placed perpendicularly to the main component of the magnetic flux in the air gap. The coil is then connected mechanically to a diaphragm or cone that is driven or vibrated by the axial motion of the coil produced by the motor force on the coil. The coil is often referred to as a voice coil because, in loudspeakers or similar electromechanical transducers, the frequency range of particular interest is the extended range of the human voice. These terms will be used interchangeably here. Cylindrical voice coils are commonly used on audio transducers such as cone drivers, dome tweeters, and microphone transducers.

The coil is normally connected to an audio amplifier of some type that produces a current in the coil that is a function of the electrical signal to be transformed by the loudspeaker into an audible, subaudible or ultrasonic pressure variation. The coil is normally disposed to carry a current in a direction that is substantially perpendicular to the direction of the lines of magnetic flux produced by the permanent magnet. The magnetic structure is often arranged to provide cylindrical symmetry with an annular air gap in which the magnet flux lines are directed radially with respect to the axis of cylindrical symmetry of the loudspeaker.

Conventional permanent-magnet electrodynamic loudspeakers employ a diaphragm that is vibrated by an electromechanical drive. The drive generally comprises a magnet and a voice coil with an electrical signal passed through the voice coil. The interaction between the current passing through the voice coil and the magnetic field produced by the permanent magnet causes the voice coil to oscillate in accordance with the electrical signal and, in turn, drives the diaphragm and produces sound.

In operation, the resistance of the conductive material of the voice coil causes the production of heat in the voice coil or winding. The tolerance of the driver to heat is generally determined by the melting points of its various components and the heat capacity of the adhesive used to construct the voice coil. As the DC resistance of the voice coil comprises a major portion of a driver's impedance, most of the input power is converted into heat rather than sound. Thus, the power handling capacity of a driver is strictly limited by its ability to tolerate heat.

The problems produced by heat generation are further compounded by temperature-induced resistance, commonly referred to as power compression. As the temperature of the driver voice coil increases, the DC resistance of copper or aluminum conductors or wires used in the driver also increases. For example, a copper wire voice coil that has a resistance of six ohms at room temperature has a resistance of twelve ohms at 270° C. (520° F.). At higher temperatures, power input is converted mostly into additional heat rather than sound, thereby seriously limiting driver efficiency.

Thus, heat production is a major determinant of speaker maximum speaker output. Generally, prior art devices are limited in their maximum power because of the heat they generate. In a typical single coil design using a ceramic magnet, the driver is very large and a heat sink is usually not employed. As such, the temperature in the driver limits the power of the loudspeaker because the driver must not overheat. A common approach in the design of high power professional loudspeakers consists of simply making the driver structure large enough to dissipate the heat generated. Producing a high power speaker in this way results in very large and heavy speaker with a large driver structure to handle the heat generated. This invention improves on this art by incorporating elements designed to dissipate the heat generated by the driver, thus, improving efficiency and producing greater power output.

Previous systems such as that described in French Patent No. 1,180,456, have attempted to achieve higher power by using a dual coil assembly. This dual coil assembly doubles the electrodynamic force produced by the same current, resulting in an increase in efficiency. PCT/US93/06755 and U.S. Pat. No. 5,231,336 also utilize a dual coil. However, these patents do not address the problem of heat generation or the size and weight of their assemblies.

Other patents have tried to control the heat generated by a loudspeaker. These patents include U.S. Pat. No. 3,991,286, which uses a highly thermally conductive voice coil and a metal frame structure, and U.S. Pat. No. 4,138,593, which use a thermally conductive structure on both sides of the magnetic circuit and thermally connects the driver to both the front panel and the rear panel of the speaker cabinet. Also, U.S. Pat. No. 5,042,072 discloses a system for introducing channels in the magnetic structure or pole piece to introduce cool air. These apparatuses help manage the generated heat but are limited in their efficiency.

By using these partial solutions, some heat can be dissipated and efficiency increased. However, these arrangements do not provide the aggregate advantages gained by the combining the dual coil, the housing, which acts as the frame, pedestal and heat sink, and the neodymium magnet.

SUMMARY

The present invention is an electromagnetic transducer able to produce more power output per transducer mass than a conventional transducer. This increased power per mass is made possible by combining a properly designed housing, a neodymium magnet and a dual coil structure. This design dissipates the heat generated by the transducer, increasing the efficiency and power of the transducer.

In a preferred embodiment, the transducer comprises a voice cylinder, a dual coil, a subassembly, an outer ring, a housing, and a cone. The voice cylinder is connected to the inside of the cone and fits in the gap between the subassembly and the outer ring. The dual coil comprises a wire coiled around the voice cylinder at two different places.

The subassembly comprises a permanent magnet, preferably made of neodymium. Using neodymium reduces the weight of the subassembly because a neodymium magnet provides more magnetic flux per weight than a standard magnet. A standard design using ceramic or alnico would have to be much larger than a neodymium magnet to provide the same amount of magnetic flux. The magnet is magnetized in the axial direction such that one surface of the magnet is magnetic north and the other magnetic south.

In addition to the magnet, the subassembly comprises a front and a rear pole plate. The pole plates are made of steel and are located on either side of the magnet, making a magnet sandwich. Using a smaller neodymium magnet also allows the use of smaller steel pole plates. By reducing the size of the magnet and the plates, the subassembly is smaller and lighter than an equivalent structure in the prior art.

The pole plates and the magnet each have a hole in their centers through which a center plug extends. The current from the amplifier is provided through the center plug, which allows current to reach the front of the subassembly and the cylinder. The use of a center plug to feed the wire to the coil reduces labor costs in assembling the speaker. The center plug has two wires extending through it with spade lugs on each end of each wire. The spade lugs allow the wire from the dual coil to be attached using a clasp without soldering, a very labor intensive activity, during assembly.

A annular ferromagnetic steel outer ring surrounds the subassembly and the dual coil. Between the outer ring and the subassembly is a magnetic gap in which the cylinder containing the dual coil is located. One coil of the dual coil is wrapped around the voice cylinder such that it is even with the rear pole plate and the other wrapped such that it is even with the front pole plate.

The transducer also comprises a housing that combines the frame, pedestal and heat sink functions, performing all three functions without the need for three structures. By using a single housing, the invention is lighter and cheaper to produce than a conventional three piece structure. In the prior art, the frame and heat sink functions have been combined, but not the pedestal. The housing provides a frame that holds the outer ring, provides a pedestal to support the subassembly and acts as a heat sink by drawing heat from both the subassembly and the outer ring. The housing dissipates the heat into the air more efficiently that the subassembly or outer ring because it has a larger surface area that maximizes contact with the air and allows a greater amount of heat to flow into the air.

By acting as a pedestal and frame, the housing contacts both the subassembly and outer ring. The two contacts provide a greater common surface area, thus, increasing the housing's ability to transfer heat from the subassembly and outer ring. Thus, having the housing also be the pedestal increases the heat sinking ability of the housing.

Once heat flows to the housing, it is dissipated into the air. Furthermore, making the housing in an irregular shape with fins increases its surface area and facilitates the dissipation of heat because there is more surface area for heat to flow into the air.

In some embodiments, this flow also is facilitated by attaching the fins of the housing near the cone. Attaching the fins near the cone causes air to move past the fins as the speaker produces sound. This air movement increases the dissipation of heat from the fins. One embodiment of attaching the fins near the cone uses the fins to make up the spoke legs of the loudspeaker basket.

By using these weight reducing and heat dissipation techniques, the loudspeaker of the invention can be made lighter and more efficient than prior art speakers. A loudspeaker utilizing the techniques of this invention can achieve the power normally seen in a speaker weighing many times as much.

Moreover, the combination heat sink, pedestal and frame would not be possible using a standard size magnet because the subassembly would be too large to encase. Thus, the efficient use of neodymium allows a smaller subassembly that can be encased by the housing. Thus, despite the higher cost of neodymium, the total magnet structure costs less than a single gap ceramic design of equal performance.

In addition, because the neodymium magnet is thinner than a standard magnet, it has very little leakage on the inside of the structure and the return path of the magnet circuit is shorter. Thus, a neodymium subassembly is very efficient and can produce greater power per mass.

In addition to the neodymium, the dual coil requires a smaller outer ring and smaller pole plates. In a normal single coil system, the current running through the coil generates a force on the voice coil cylinder. However, in the dual coil system, the forces from each coil are added, creating a more powerful speaker. Thus, the efficiency of and the power produced by the loudspeaker are increased with the same mass as a conventional system.

In addition, the dual coil also doubles the surface area of the winding. The number of winds and thus the surface area of the winding is determined by the design of the speaker. But, by using a dual coil, the number of windings is doubled and the surface area of the windings is doubled, nearly doubling the capacity of the wire to dissipate heat and increasing speaker power.

Only the combination of the dual coil, neodymium magnet, and properly designed housing produce the highly efficient transducer of the invention. Any partial combination of these techniques would increase speaker efficiency and power, but not by the magnitude produced by the combination of all three.

Thus, it is the primary object of this invention to provide a lightweight, powerful loudspeaker.

It is a further object of this invention to provide a combination heat sink, pedestal and frame that, for less weight, provides very efficient heat dissipation.

It is another object of this invention to use dual coils increase the efficiency of the speaker and allow a reduction in weight of the speaker.

It is yet another object of this invention to use a lightweight magnet like neodymium to reduce the weight of a loudspeaker.

It is another object of this invention to produce a powerful and very efficient speaker using improved design techniques.

DETAILED DESCRIPTION

Figure 2:
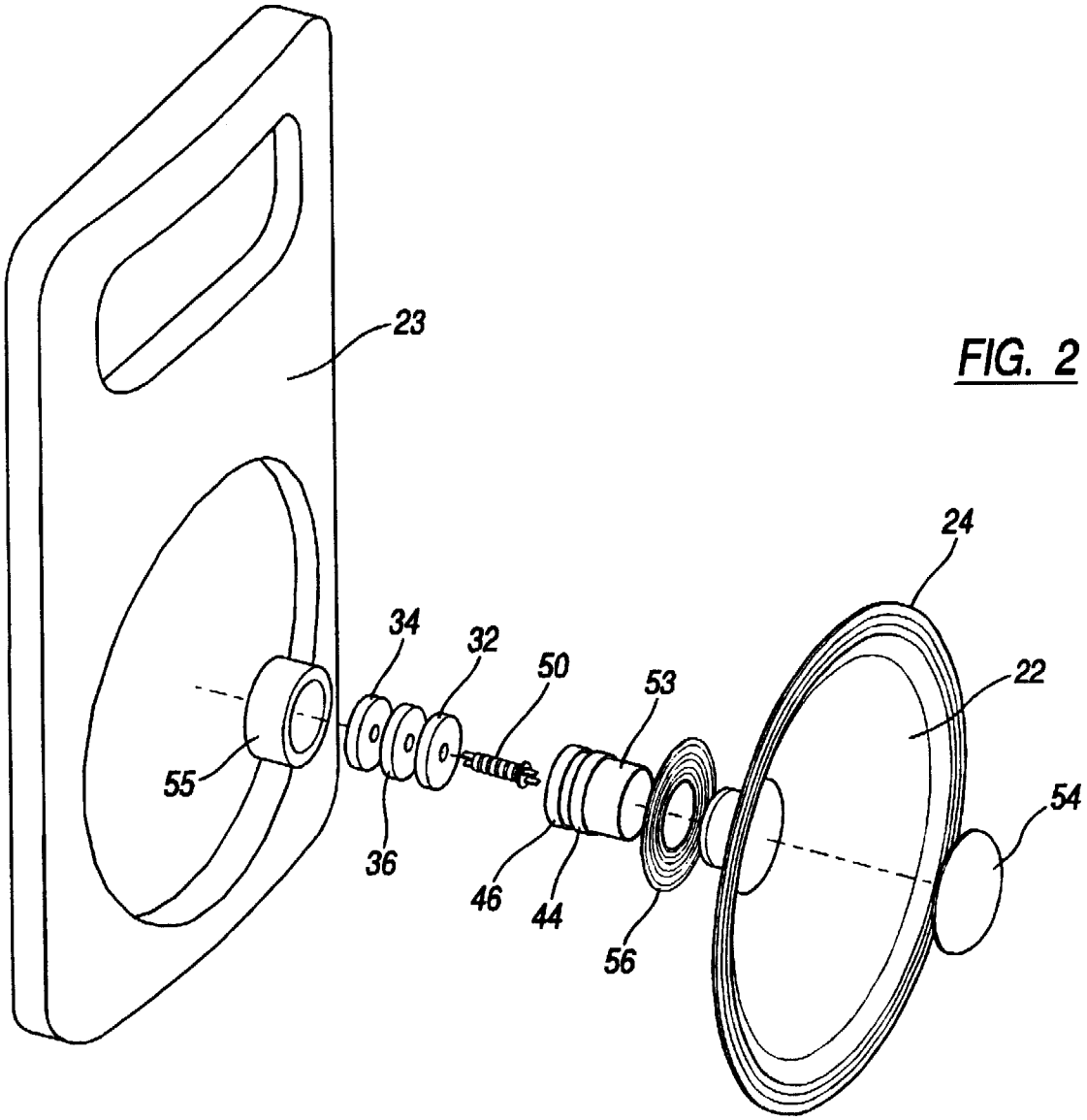
FIG. 2 is a front exploded view of the loudspeaker.

In the preferred embodiment, depicted in FIG. 2, the loudspeaker 20 comprises an external cone 22 attached to the front of the speaker cabinet or baffle 23 by a flexible mounting 24. The cone 22, under the dome 54, is affixed to a cylinder 53.

Figure 1:
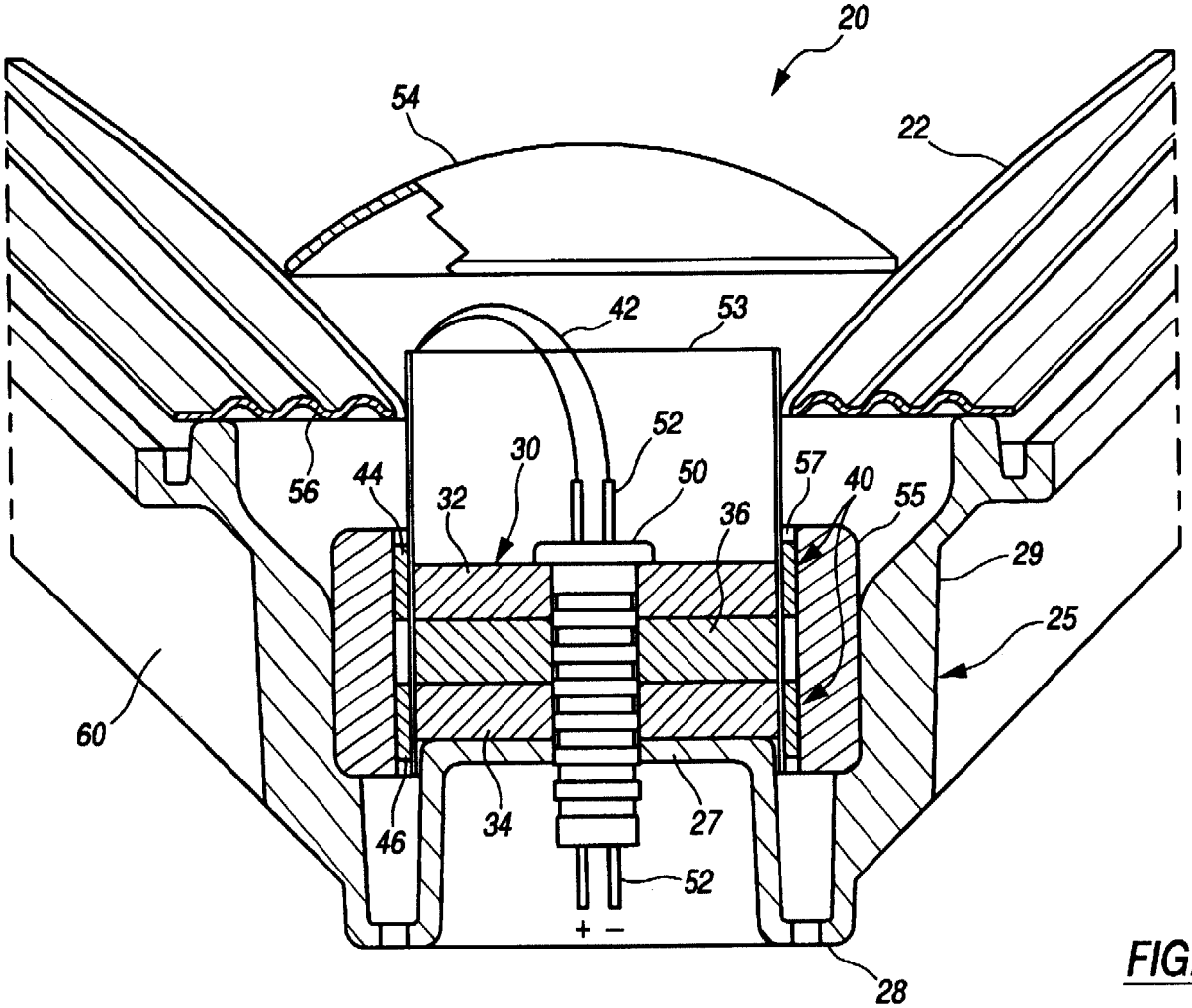
FIG. 1 is a side view of the loudspeaker.

Referring to FIG. 1, in addition, the cone 22 is linked to a housing 25 by a spider connector 56. The spider connector 56 is sufficiently flexible to allow the cone 22 to move axially, but provides sufficient support to hold the cone 22 in position radially.

The loudspeaker 20 comprises a subassembly 30 comprising a magnet 36 and two pole plates, a front pole plate 32 and a rear pole plate 34. The pole plates 32, 34 are made of steel and are ferromagnetic. In the preferred embodiment, the pole plates 32, 34 are constructed in a cylindrical shape with a greater radius than height.

Sandwiched between the front 32 and rear 34 pole plates is a magnet 36 that, together with the pole plates 32, 34, makes a stack. In the preferred embodiment, the magnet 36 is made of neodymium, a material that has a high magnetic flux per mass. In the preferred embodiment, the magnet 36 also is cylindrical with a radius slightly smaller than that of the front 32 and rear 34 pole plates. By using neodymium, the magnet 36 can be thinner and smaller in diameter than a conventional magnet made of ceramic and much thinner and smaller than a magnet made of alnico.

The pole plates 32, 34 and the magnet 36 have a center hole that, when the pole plates 32, 34 and magnet 36 are stacked, extends through the subassembly 30. A center plug 50 is located in this hole, extending from the rear to the front of the subassembly 30. The center plug 50 has two conducting elements through it, preferably wire, that extend out the ends of the plug 50 where they end at spade lugs 52. The spade lugs 52 allow another wire to be attached using a clasp-like device and without soldering.

In the preferred embodiment, the magnet 36 and the pole plates 32, 34 are located within an annular outer ring 55. Like the pole plates 32, 34, the outer ring 55 is made of ferromagnetic steel. The outer ring 55 is a hollow cylinder slightly longer than the combined heights of the two pole plates 32, 34 and the magnet 36. The subassembly 30 fits within the outer ring 55 such that the inner radius of the outer ring 55 is slightly larger than the radius of the pole plates 32, 34. The slightly larger radius of the outer ring 55 provides an annular magnetic gap 57 between the front pole plate 32, magnet 36, rear pole plate 34 stack and the outer ring 55.

In an alternate embodiment, the exterior surface of the pole plates 32, 34 and the interior surface of the outer ring 55 are covered with copper sheathing. Coating the portions of these elements in the magnetic gap 57 with copper reduces distortion and inductance in the loudspeaker. The copper sheaths can be plated to a thickness of 0.015 to 0.025 inches.

Alternatively, conductive shorting rings can be used to reduce distortion and inductance. Rather than being placed in the magnetic gap 57 like the copper sheathing, the conductive rings are placed in front of the front plate 32, on the exterior surface of the magnet 36 and behind the rear plate 34. The conductive shorting rings can be made of copper or aluminum and are between 0.050 and 0.150 inches thick in the radial direction.

The housing 25 is comprised of portions that provide a frame 29 for the outer ring 55 and a pedestal 27 for the subassembly 30 with the two connected through bend 28. Additionally, the housing 25 acts as a heat sink for the loudspeaker 20 by allowing heat to flow from the outer ring 55 and the subassembly 30 into the housing 25. In the preferred embodiment, the housing 25 is made of aluminum.

The cylinder 53, which is attached to the cone 22, extends from the cone 22 into this magnetic gap 57. The cylinder 53 is made of a stiff high temperature resistant material such as polyamide and is preferably about 5/1000 of an inch thick. Wound around the cylinder 53 and within the magnetic gap 57 is a dual coil 40 of wire 42 comprised of two portions, a front portion 44 and a rear portion 46. The wire 42 in the front portion 44 is wrapped around the cylinder 53 such that it lines up with the front pole plate 32. Similarly, the wire 42 in the rear portion 46 is wrapped around the cylinder 53 such that it lines up with the rear pole plate 34.

The center plug 50 contains two conductors that extend through its length. The conductors extend out the front and rear of the center plug 50. The edges of the conductors on the rear of the center plug 50 are connected to wires that lead to the amplifier that drives the loudspeaker 20. On the front of the center plug 50, the wire 42 connects to two spade lugs on the front of the center plug 50 using clasp-like connectors.

From the center plug 50 at the front of the subassembly 30, the wire 42 runs to the top of the cylinder 53, under the dome 54, and down the outside of the cylinder 53 until it reaches the position of the front portion 44, where it is wrapped around the cylinder 53 clockwise. After being wrapped around the cylinder 53, the wire 42 runs along the cylinder 53 from the front portion 44 to the rear most part of the rear portion 46. This part of the wire 42 is insulated to prevent electrical contact between the portion of the wire 42 extending down the cylinder 53 and the portion wrapped around the cylinder 53. At the rear most part of the rear portion 46, the wire 42 is wrapped around the cylinder 53 counterclockwise and makes up the rear portion 46.

After making up the rear portion 46, the wire 42 is insulated and runs up the side of the cylinder 53 to the top of the cylinder 53. From the top of the cylinder 53, the wire 42 extends down to the center plug 50 where it is clasped onto the other spade lug on the front of the center plug 50.

The preferred number of times that the wire 42 is wrapped around the cylinder 53 is determined by the design of the loudspeaker and is well known to the art. This preferred number of windings is used for both the front 44 and rear 46 portions of the dual coil 40, thus, doubling the number of windings and doubling the surface area covered by the wire 42 without increasing the size of the magnetic gap 57.

Running the wire 42 in the front portion 44 clockwise and in the rear portion 46 counterclockwise causes the current in the front portion 44 to run in the opposite direction from the current in the rear portion 46. Because the flux lines run in opposite directions in each air gap and the current in each coil runs in opposite directions, Lorenz law holds that the force created by the current in each coil is in the same direction thus, doubling the force on the cylinder 53. By doubling the force, the speaker generates more power than a single coil speaker.

In addition to generating force, running current through the wire 42 and dual coil 40 generates heat. The heat from the wire 42 flows into the front pole plate 32 and the rear pole plate 34 where the wire 42 nears those pole plates. The heat also flows into the outer ring 55 at the two places the wire 42 nears the outer ring 55. If the heat generated by the wire 42 is not dissipated, the pole plates 32, 34 and the magnet 36 will continue to get hotter. Eventually, the adhesive holding the wire 42 onto the cylinder 53 will melt, detaching the wire 42 from the cylinder 53, and causing the loudspeaker 20 to cease functioning. Moreover, neodymium magnets will demagnetize if they get too hot, for example, above 250° F.

The heat generated by a loudspeaker 20 is directly proportional to the power that the loudspeaker 20 is capable of producing, and thus the volume the loudspeaker can produce. Moreover, the hotter the wire 42 becomes, the higher its resistance becomes and the more heat it generates. Thus, creating more powerful loudspeakers requires developing a technique for handling the resulting heat.

The ability of the housing 25 to dissipate the heat generated by the coil 40 makes the loudspeaker 20 more powerful. Without the heat sink of the housing 25, doubling in dissipation capability, for example, the power in the loudspeaker 20 would about double the temperature generated. Unless the loudspeaker 20 was underpowered originally, doubling the temperature would damage the components of the loudspeaker 20 and cause the loudspeaker 20 to stop working. Thus, increasing power in the loudspeaker 20 requires a technique to dissipate heat.

One technique utilized by this invention to manage heat is the dual coil 40 winding of the wire 42. By winding the wire 42 at two different places with twice the surface area on the cylinder 53, the subassembly 30 and the outer ring 55, heat can pass to different places and over a larger area. By passing in different areas and over a larger area, heat can dissipate faster, provided that heat can flow from the outer ring 55 and subassembly 30. However, without providing for the release of heat from the outer ring 55 and subassembly 30, the design advantages of the double coil would be compromised.

Figure 3:
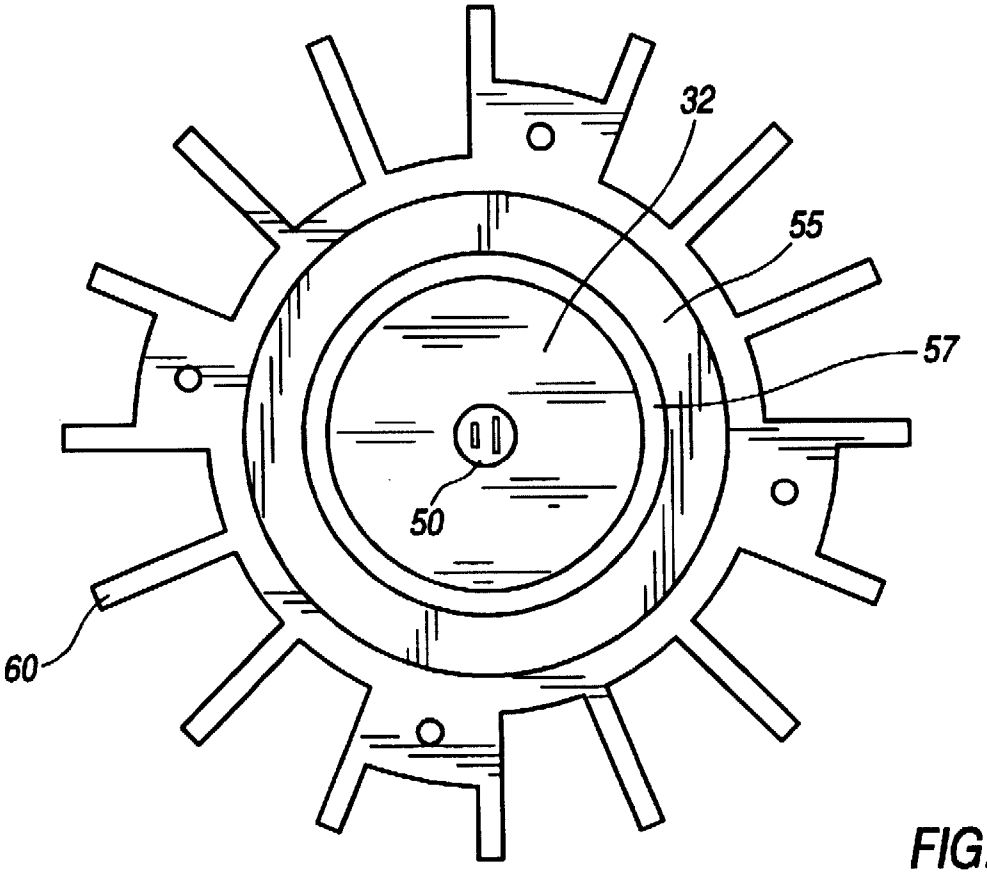
FIG. 3 is a front view of one embodiment of the housing, subassembly and outer ring.
Figure 4:
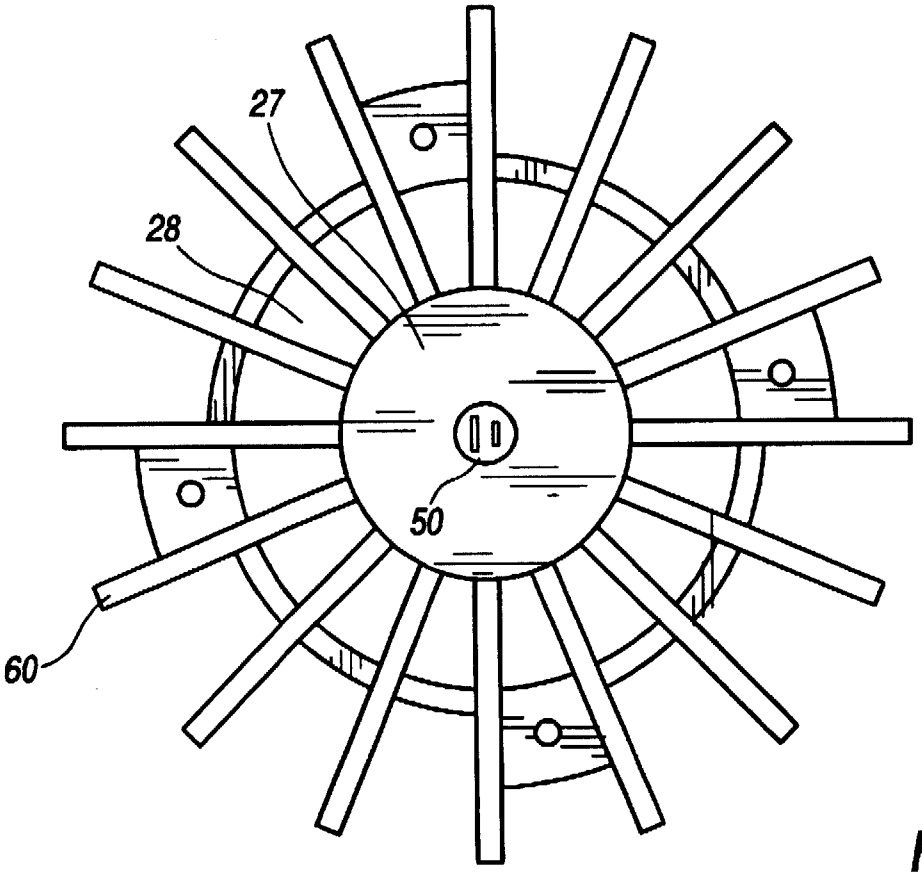
FIG. 4 is a rear view of one embodiment of the housing, subassembly and outer ring.

To allow heat to flow from the outer ring 55 and the subassembly 30, the housing 25 is attached to the outer ring 55 and the subassembly 30. The housing 25 then acts as a heat sink into which heat from the outer ring 55 and subassembly 30 can flow. Heat that flows into the housing 25 is dissipated by the housing 25 because of its greater surface area. Referring to FIGS. 3 and 4, in the preferred embodiment, the surface area of the housing 25 is increased by adding radial or other high surface area fins 60 to the housing, particularly, extending from the frame 29 portion of the housing 25. As noted in FIGS. 1, 3 and 4, the frame portion 29 of the housing is cylindrical, is concentric with the outer ring and is in engagement with a substantial portion of the exterior surface of the outer ring. As best seen in FIG. 1, the thickness of the frame portion 29 of the housing is substantial with respect to the thickness of the outer ring 55 permitting the housing to act as an effective heat sink. The fins are mounted on the frame portion 29 of the housing, i.e., the portion of the housing which is in engagement with the outer ring 55.

The fins 60 enable a certain size housing 25 to have a substantially greater surface area than a similarly sized housing with a regular or compact shape. Any shape fins or other irregularity in shape can be used to increase the surface area of the housing. FIGS. 3 and 4 contain an example of fins in which the surface area can be further increased by adding more fins or decreased by reducing the number of fins. Additionally, other surface irregularities such as bumps or other protrusions can increase the surface area of the housing. Because heat flows to the air from the surface of the housing 25, the larger the surface area of the housing 25 the greater the heat dissipation.

Additionally, more heat can be dissipated by blowing air across the housing 25. Because the heat flows from the housing 25 to the air, the flow of air quickens the dissipation of heat from the housing 25. For example, a fan can be utilized to move air within the loudspeaker cabinet.

In the preferred embodiment, air flow across the housing 25 is accomplished by positioning the fins 60 of the housing 25 near the cone 22. The vibration of the cone 22 as the loudspeaker 20 produces sound vibrates the fins 60 and moves air past the fins. The movement of air over the fins 60 increases their ability to dissipate heat into the air.

In one embodiment, radial fins 60 form the spoke legs of a loudspeaker basket. In this type of embodiment, the fins 60 attach to a ring that connects to the loudspeaker baffle 23. Alternatively, the fins can connect directly to the baffle 23 by combining the ring with the baffle 23. By attaching the fins 60 in this way, the housing 25 spans from the subassembly 30 to the baffle 23, providing greater surface area and increased heat dissipation. Additionally, the loudspeaker baffle 23 can be made of aluminum which, due to the connection between the fins 60 and the baffle 23, allows heat to flow from the housing 25 into the baffle 23. Because heat can flow into the baffle 23 in this embodiment, the baffle 23 also acts as a heat sink, further increasing the heat dissipation ability of the invention.

Also, using the fins 60 as part of a loudspeaker basket incorporates the greater heat dissipation of the invention into a conventional loudspeaker basket design. Using a loudspeaker basket incorporating the invention, existing speakers can be improved by replacing their present ring, loudspeaker basket and transducer with a transducer, basket and ring incorporating the invention herein. Thus, an existing loudspeaker can benefit from the reduced weight and increased power of the invention.

Combining the heat sink, pedestal and frame functions in the housing 25 is possible because of the neodymium magnet. Because of the greater magnetic flux it produces, a neodymium magnet can be made smaller than a standard magnet and still provide the flux required for the loudspeaker 20. A standard magnet would be too large and heavy for a combination heat sink, pedestal and frame to be practical. The smaller neodymium magnet requires a smaller housing 25, thus, allowing a single structure to function as a frame, pedestal and heat sink.

In addition to the teachings herein, this invention can be combined with the teachings of U.S. Pat. No. 5,042,072 to reduce the heat in the subassembly 30 and voice coil 40 using venting as well as the teachings of this invention. Moreover, the venting technique can be combined with the invention and its copper plating embodiment taught herein.

While the invention has been shown and described with respect to a particular embodiment, this is for the purpose of illustration rather than limitation. The inventor envisions, and it will be apparent to those skilled in the art, that other variations and modifications of the embodiment shown and described herein are all within the intended spirit and scope of the invention. Accordingly, the patent is not to be limited in scope and effect to the specific embodiment shown and described nor in any other way that is inconsistent with the extent to which the progress and the art has been advanced by the invention.

I claim:

1. An electromagnetic transducer comprising:

a cone for producing sound vibrations in the air, said cone having a front and a back surface;

a permanent magnet with a front and a back surface, said magnet being thermally conductive;

a front steel pole plate with a front and a back surface arranged such that the back surface of said front pole plate is face-to-face with the front surface of said magnet;

a rear steel pole plate with a front and a back surface arranged such that the front surface of said rear pole plate is face-to-face with the rear surface of said magnet;

a non-magnetic cylinder, attached to the back surface of said cone and extending annularly around said front and said rear pole plates and said magnet;

a wire comprising a dual coil wrapped around said cylinder, said dual coil comprising a first coil portion wrapped around said cylinder even with said front pole plate and a second coil portion wrapped around said cylinder even with said rear pole plate such that current in each said coil portion flows in opposite directions;

an annular steel outer ring encompassing and flush with each of said front pole plate, said rear pole plate, and said magnet;

a housing providing a frame around said annular outer ring and supplying a pedestal attached to the back surface of said rear pole plate and supporting said rear pole plate, said front pole plate and said magnet;

said magnet and said rear and front pole plates each contain a hole in their respective centers;

a center plug extending axially through the holes in the centers of said magnet and said front and rear pole plates, said wire extending from the back surface of said rear pole plate through said center plug to the front surface of said front pole plate; and wherein said housing and said outer ring act as a heat sink by providing a path for heat to flow from said outer ring and said rear pole plate into said housing from which housing the heat can dissipate.

2. In an audio transducer having a cone for producing sound when vibrated, a non-magnetic cylinder attached to said cone, a housing, an electro-mechanical assembly attached to the housing and inside the cylinder and a ferromagnetic steel outer ring surrounding the assembly and inside the housing, an improved transducer comprising the combination of:

a neodymium permanent magnet sandwiched between opposing steel ferromagnetic pole plates and forming said assembly;

first and second wire coils wound around said non-magnetic cylinder and spaced to coincide with said opposing steel pole plates, said first and second wire coils being connected in a series relationship;

said first and second coils wound such that the electrical current in said first coil travels around said cylinder in the opposite direction from the electrical current in said second coil;

said magnet, said rear pole plate and said front pole plate each containing a hole in their respective centers;

a center plug extending axially through the holes in the centers of said magnet, said rear pole plate and said front pole plate;

a portion of said wire coils extending through said center plug; and said housing acting as a frame for said outer ring and a pedestal for said assembly and providing a heat sink for dissipating the heat generated by said assembly.

3. An electromagnetic transducer comprising:

a cone for producing sound vibrations in the air, said cone having a front and a back surface;

a permanent magnet with a front and a back surface, said magnet being thermally conductive;

a front steel pole plate with a front and a back surface arranged such that the back surface of said front pole plate is face-to-face with the front surface of said magnet;

a rear steel pole plate with a front and a back surface arranged such that the front surface of said rear pole plate is face-to-face with the rear surface of said magnet;

a non-magnetic cylinder, attached to the back surface of said cone and extending annularly around said front and said rear pole plates and said magnet;

a wire comprising a dual coil wrapped around said cylinder, said dual coil comprising a first coil portion wrapped around said cylinder even with said front pole plate and a second coil portion wrapped around said cylinder even with said rear pole plate such that current in each said coil portion flows in opposite directions;

an annular steel outer ring encompassing and flush with each of said front pole plate, said rear pole plate, and said magnet; and a housing providing a frame around said annular outer ring and supplying a pedestal attached to the rear surface of said rear pole plate and supporting said rear pole plate, said front pole plate and said magnet, said housing having a portion thereof in engagement with a substantial portion of said outer ring;

wherein said housing and said outer ring act as a heat sink by providing a path for heat to flow from said outer ring and said rear pole plate into said housing from which housing the heat can dissipate, said housing including a plurality of radially extending fins, said fins being formed on the portion of the housing which is in engagement with said outer ring.

4. The transducer of claim 3 wherein said magnet, said rear pole plate and said front pole plate contain a hole in their respective centers.

5. The transducer of claim 4 including a center plug extending axially through the hole in the center of said magnet, said rear pole plate and said front pole plate.

6. The transducer of claim 3 wherein said housing is made of aluminum.

7. The transducer of claim 3 wherein said fins have ends, said ends connected to a mounting ring of the transducer.

8. The transducer of claim 3 wherein said fins have ends, said ends connected to a loudspeaker baffle.

9. The transducer of claim 3 wherein said pole plates have an exterior surface, the exterior surface being covered with copper sheathing, and said outer ring having an interior surface, the interior surface being covered with copper sheathing.

10. The transducer of claim 3 wherein the dual coil increases the surface area of the wire on the cylinder which increases the heat dissipation capability of the transducer.

11. The transducer of claim 3 wherein the permanent magnet is comprised of neodymium.

12. A transducer according to claim 3 wherein said portion of housing which is in engagement with said outer ring is cylindrical and is concentric with the outer ring, and wherein said portion of the housing has a thickness which is at least as thick as the thickness of the outer ring.

13. In an audio transducer having a cone for producing sound when vibrated, a non-magnetic cylinder attached to said cone, a housing, an electro-mechanical assembly attached to the housing and inside the cylinder and a ferromagnetic steel outer ring surrounding the assembly and inside the housing, an improved transducer comprising the combination of:

a thermally conducting permanent magnet sandwiched between opposing steel ferromagnetic pole plates and forming said assembly;

first and second wire coils wound around said non-magnetic cylinder and spaced to coincide with said opposing steel pole plates, said first and second wire coils being connected in a series relationship;

said first and second coils wound such that the electrical current in said first coil travels around said cylinder in the opposite direction from the electrical current in said second coil;

said outer ring being flush with said front pole plate, said rear pole plate and said magnet; and said housing acting as a frame for said outer ring and a pedestal for said assembly and having a portion thereof in engagement with a substantial portion of said outer ring, said housing including a plurality of a radially extending fins formed on the portion of said housing which is in engagement with said outer ring thereby providing a heat sink for dissipating the heat generated by said assembly.

14. The audio transducer of claim 13 wherein said magnet, said rear pole plate and said front pole plate contain a hole in their respective centers.

15. The audio transducer of claim 14 including a center plug extending axially through the hole in the center of said magnet, said rear pole plate and said front pole plate.

16. The audio transducer of claim 13 wherein said housing is made of aluminum.

17. The audio transducer of claim 13 wherein said fins have ends, said ends connected to a mounting ring of the transducer.

18. The audio transducer of claim 13 wherein said fins have ends, said ends connected to a loudspeaker baffle.

19. The audio transducer of claim 13 wherein said pole plates have an exterior surface, the exterior surface being covered with copper sheathing, and said outer ring having an interior surface, the interior surface being covered with copper sheathing.

20. The audio transducer of claim 13 wherein the dual coil increases the surface area of the wire on the cylinder which increases the heat dissipation capability of the transducer.

21. The audio transducer of claim 3 wherein the permanent magnet is comprised of neodymium.

22. A transducer according to claim 13 wherein said portion of the housing which is in engagement with said outer ring is cylindrical and is concentric with the outer ring, and wherein said portion of the housing has a thickness which is at least as thick as the thickness of the outer ring.

23. In an audio transducer with a longitudinal axis extending from front to rear, a cabinet, a cone mounted on said cabinet for producing sound when vibrated, and an electromechanical assembly for vibrating said cone, an improved electromechanical assembly comprising:

a magnetic assembly having a thermally conducting permanent magnet sandwiched between opposing steel plates spaced along said longitudinal axis in a superimposed relationship;

a non-magnetic cylinder associated with said cone and enclosing said magnetic assembly;

first and second wire coils wound around said non-magnetic cylinder and spaced to coincide with said opposing steel pole plates, said first and second wire coils being connected such that current in each said coil portion flows in opposite directions;

an annular steel ring encompassing at least a portion of said non-magnetic cylinder to provide a magnetic path that includes said first and second wire coils, said steel ring being flush with said magnetic assembly; and a frame supporting the ring and the magnetic assembly and having a portion thereof in engagement with a substantial portion of said ring, said frame including a plurality of radially extending fins formed on the portion of said frame which is in engagement with said ring thereby providing a heat sink.

24. A transducer according to claim 23 wherein said portion of the housing which is in engagement with said outer ring is cylindrical and is concentric with the outer ring, and wherein said portion of the housing has a thickness which is at least as thick as the thickness of the outer ring.

* * * * *